US010526843B2

(12) United States Patent
Maddamma

(10) Patent No.: US 10,526,843 B2
(45) Date of Patent: Jan. 7, 2020

(54) RETRACTABLE GATE SYSTEM

(71) Applicant: Universal City Studios LLC, Universal City, CA (US)

(72) Inventor: Michael Maddamma, Deltona, FL (US)

(73) Assignee: Universal City Studios LLC, Universal City, CA (US)

( * ) Notice: Subject to any disclaimer, the term of this patent is extended or adjusted under 35 U.S.C. 154(b) by 165 days.

(21) Appl. No.: 15/655,575

(22) Filed: Jul. 20, 2017

(65) Prior Publication Data

US 2019/0024454 A1 Jan. 24, 2019

(51) Int. Cl.
*E06B 9/06* (2006.01)
*E06B 11/02* (2006.01)
(Continued)

(52) U.S. Cl.
CPC ..... *E06B 11/022* (2013.01); *A63G 31/00* (2013.01); *E05B 65/0007* (2013.01);
(Continued)

(58) Field of Classification Search
CPC .... E06B 11/026; E06B 11/023; E06B 11/022; E06B 11/02; E06B 11/045; E06B 9/0692; E06B 9/0676; E06B 2009/002; E06B 9/0638; E06B 9/0669; E05Y 2900/40; E05F 1/16; E05F 15/56; E05C 19/16; E05C 19/166; E05C 19/168; E04F 11/068; E04F 2011/005; E04F 2011/187; E04F 13/044; E04F 13/046; E04F 13/048; E05B 65/0007; A63B 71/022; A63B 2210/50; A01K 1/0017; A01K 1/0023; A01K 1/0029; A47H 13/02
USPC ..... 256/73, 67; 273/395, 407; 473/421, 473/416; 119/524; 160/110, 112, 124, 160/125
See application file for complete search history.

(56) References Cited

U.S. PATENT DOCUMENTS 56,693 A * 7/1866 Babcock ..... E06B 11/045 49/427
254,994 A * 3/1882 McCleary ..... E06B 11/045 49/289
(Continued)

FOREIGN PATENT DOCUMENTS

CA 2558939 A1 3/2008

OTHER PUBLICATIONS

PCT/US2018/041466 International Search Report and Written Opinion dated Oct. 26, 2018.

*Primary Examiner* — Kyle J. Walraed-Sullivan
(74) *Attorney, Agent, or Firm* — Fletcher Yoder, P.C.

(57) ABSTRACT

A gate system includes a first fixed support structure having a plurality of fixed rails defining respective passageways and a gate that moves relative to the fixed support structure between an open position and a closed position. The gate includes a plurality of gate rails that slide within the respective passageways as the gate moves between the open position and the closed position. Furthermore, the gate includes one or more compressible sheets coupled to the plurality of gate rails, and the one or more compressible sheets are configured to move from a compressed position to an expanded position as the gate moves from the open position to the closed position.

20 Claims, 8 Drawing Sheets

(51) Int. Cl.

| | |
|---|---|
| ***E05F 15/56*** | (2015.01) |
| ***E05B 65/00*** | (2006.01) |
| ***E05C 19/16*** | (2006.01) |
| ***E05F 1/16*** | (2006.01) |
| ***A63G 31/00*** | (2006.01) |
| *E06B 9/00* | (2006.01) |
| *E06B 11/04* | (2006.01) |

(52) U.S. Cl.

CPC ..... *E05C 19/166* (2013.01); *E05F 1/16* (2013.01); *E05F 15/56* (2015.01); *E06B 11/026* (2013.01); *E05Y 2900/40* (2013.01); *E06B 11/045* (2013.01); *E06B 2009/002* (2013.01)

(56) References Cited

U.S. PATENT DOCUMENTS 312,101 A * 2/1885 Elliott ..... B65D 7/20 220/494
358,956 A * 3/1887 Bataille ..... E06B 11/02 160/144
361,175 A * 4/1887 McCracken ..... A47H 13/02 24/716
498,576 A * 5/1893 Sanford ..... E04B 1/0046 52/764
585,273 A * 6/1897 Lathrop ..... E06B 11/02 160/151
623,305 A * 4/1899 Bugge ..... E06B 9/52 160/44
717,330 A * 12/1902 Bowsher ..... E06B 11/02 49/159
731,716 A * 6/1903 Slater ..... E06B 11/045 49/427
911,189 A * 2/1909 Wisterman ..... E05B 65/0007 27/35
1,044,351 A * 11/1912 Clay ..... E06B 11/02 160/156
1,147,944 A * 7/1915 Holdensen ..... A47H 1/022 160/125
1,245,249 A * 11/1917 Lunken ..... E06B 9/0638 160/33
1,290,176 A * 1/1919 Griffith ..... E06B 11/02 109/3
1,581,185 A * 4/1926 Ellis ..... E05C 19/003 105/285
1,606,632 A * 11/1926 Harris ..... B60J 1/2011 160/125
1,718,649 A * 6/1929 Jackson, Jr. ..... E06B 3/481 160/137
1,721,998 A * 7/1929 Jackson, Jr. ..... E06B 3/922 160/137
2,455,018 A * 11/1948 McKeown ..... E05F 15/627 49/102
2,475,416 A * 7/1949 Williams ..... E04H 1/12 256/25
2,523,383 A * 9/1950 Majkrzak ..... E06B 9/0692 160/378
2,544,008 A * 3/1951 Coleman ..... E06B 3/481 160/229.1
2,701,927 A * 2/1955 Dyer ..... E06B 11/02 49/163
2,808,264 A * 10/1957 Scalf ..... A63B 63/083 124/1
2,819,901 A * 1/1958 Mateja ..... A63B 71/022 160/351
2,823,034 A * 2/1958 Bingham, Jr. ..... A63B 71/022 273/459
2,873,904 A * 2/1959 McCormick ..... E04F 11/18 14/71.1
3,037,593 A * 6/1962 Webster ..... E04B 2/7425 52/476
3,174,314 A * 3/1965 Johnson ..... E05B 65/0007 292/148
3,314,469 A * 4/1967 Kaufman ..... E06B 9/0623 160/159
3,401,918 A * 9/1968 Wiese ..... E04H 3/123 256/59
3,724,527 A 4/1973 Johns
3,757,894 A * 9/1973 Chamberlin ..... E06C 1/39 182/106
3,803,765 A * 4/1974 Ritner ..... E05D 15/0621 49/427
3,810,442 A * 5/1974 Jacobs ..... A01K 1/12 119/14.03
3,885,616 A * 5/1975 Berkowitz ..... E06B 9/0623 160/215
3,964,215 A * 6/1976 Hartman ..... E04H 3/123 52/9
3,995,832 A * 12/1976 Wiese ..... E04H 3/123 256/59
4,030,255 A * 6/1977 Hartman ..... E04H 3/123 182/106
4,072,295 A * 2/1978 Roberts ..... A63B 71/022 256/26
4,261,292 A * 4/1981 Le Du ..... A01K 1/12 119/14.04
4,342,355 A * 8/1982 Geller ..... B60S 3/04 160/331
4,381,626 A * 5/1983 Courtis ..... E05F 1/1075 49/139
4,470,221 A * 9/1984 Courtis ..... E05F 1/1075 49/331
4,489,941 A * 12/1984 Shieh ..... A63B 71/022 273/395
4,506,477 A * 3/1985 Castle ..... A47H 1/022 160/90
4,557,311 A * 12/1985 Reining ..... E04F 10/02 160/330
4,723,374 A * 2/1988 Peterson ..... E06B 11/045 49/394
4,787,174 A * 11/1988 Brown ..... E06B 9/02 49/55
4,791,757 A * 12/1988 Orlando ..... E06B 11/045 49/360
4,796,385 A * 1/1989 Tyler ..... E05B 47/026 49/280
4,865,110 A * 9/1989 Seal ..... A01K 3/00 160/332
4,887,393 A * 12/1989 Cysewski ..... E05F 1/1075 49/385
4,986,031 A * 1/1991 Agnew ..... E05F 1/1075 49/340
5,048,587 A * 9/1991 York ..... E06B 9/52 160/105
5,213,312 A * 5/1993 MacDonald ..... E01F 13/022 160/351
5,450,889 A * 9/1995 Jones ..... A47H 15/02 160/330
5,494,261 A * 2/1996 Gandara ..... E04H 17/166 256/24
5,531,258 A * 7/1996 Poulson ..... E06B 9/02 160/371
5,628,495 A * 5/1997 Gandara ..... E04H 17/165 256/24
5,638,885 A * 6/1997 Freese ..... E06B 9/02 160/225
5,704,164 A * 1/1998 Huang ..... E06B 9/02 160/372
5,718,414 A * 2/1998 Deloach ..... E04H 17/163 256/24
5,771,505 A * 6/1998 Reynolds ..... A47K 3/001 160/222
5,797,218 A * 8/1998 Holland ..... E06B 9/04 49/55
5,845,692 A 12/1998 Kellem et al.
6,058,885 A * 5/2000 Putze ..... B60P 1/02 119/407

(56) References Cited

U.S. PATENT DOCUMENTS 6,202,729 B1 * 3/2001 Cunningham ..... E06B 9/0623 160/136
6,375,165 B1 * 4/2002 Sherratt ..... E06B 9/0692 256/1
6,406,002 B1 * 6/2002 Hardy, III ..... E01F 13/022 256/23
6,474,021 B2 * 11/2002 Homeyer ..... A47D 7/002 160/372
6,536,502 B2 * 3/2003 Britto ..... E06B 9/08 160/23.1
6,789,786 B1 * 9/2004 Schatzberg ..... E04H 4/06 256/25
6,814,026 B2 * 11/2004 Guo ..... A01K 1/12 119/14.02
6,849,009 B1 * 2/2005 Forlini ..... A63B 71/022 473/446
7,055,458 B2 * 6/2006 Guo ..... A01J 5/0175 119/14.02
7,219,709 B1 * 5/2007 Williams ..... E01F 13/028 160/24
7,913,982 B2 * 3/2011 Svedberg ..... E04G 5/14 256/32
8,176,677 B1 * 5/2012 Blackmon, III ..... E06B 11/045 49/124
8,176,965 B1 * 5/2012 Motosko ..... E06B 9/0692 160/328
8,196,353 B2 6/2012 Loidolt
8,418,643 B2 * 4/2013 Povich ..... B63B 17/04 114/364
8,863,811 B2 * 10/2014 Yates ..... E06B 9/0623 160/136
9,217,273 B2 * 12/2015 Floersch ..... E06B 5/006
9,689,189 B1 6/2017 Zinda
D813,787 S * 3/2018 Thomas ..... D12/414
10,094,166 B2 * 10/2018 Reiner ..... E06B 9/60
10,100,574 B2 * 10/2018 Reiner ..... E06B 9/18
2003/0102956 A1 * 6/2003 McManus ..... G07C 11/00 340/5.2
2004/0011294 A1 * 1/2004 Guo ..... A01J 5/0175 119/14.02
2006/0162872 A1 7/2006 Prismall
2006/0180284 A1 * 8/2006 Wiggins ..... E06B 9/02 160/368.1
2007/0000182 A1 * 1/2007 Boujon ..... A63B 5/11 52/2.17
2007/0049428 A1 * 3/2007 Stromsborg ..... A63B 71/022 473/451
2007/0246174 A1 * 10/2007 Barrese ..... A47H 1/02 160/330
2008/0169069 A1 * 7/2008 Coleman ..... E06B 3/94 160/199
2008/0216408 A1 * 9/2008 Letkeman ..... E05D 15/264 49/340
2009/0044918 A1 * 2/2009 Goodman ..... E05B 65/0085 160/202
2009/0139144 A1 * 6/2009 Gill ..... E06B 3/921 49/168
2009/0236051 A1 * 9/2009 Beggs ..... E05F 1/16 160/262
2010/0083577 A1 * 4/2010 Flannery ..... E06B 9/06 49/130
2010/0243181 A1 * 9/2010 O'Connor ..... A47K 3/38 160/236
2011/0195804 A1 * 8/2011 Hixon ..... A63B 71/022 473/451
2012/0056144 A1 * 3/2012 Woods ..... E06B 11/02 256/73
2012/0097018 A1 * 4/2012 Schoenheit ..... F41H 5/0442 89/36.02
2012/0144745 A1 * 6/2012 Yates ..... E06B 9/0653 49/55
2012/0261632 A1 * 10/2012 Bertucat ..... E01F 13/022 256/26
2012/0285099 A1 * 11/2012 Yates ..... E06B 9/0623 49/503
2013/0086842 A1 * 4/2013 Morrone, III ..... E06B 9/063 49/55
2013/0145543 A1 * 6/2013 Cittadino ..... A47H 13/02 13/2
2013/0219790 A1 * 8/2013 Honeycutt ..... E06B 11/00 49/176
2014/0005003 A1 * 1/2014 Howell ..... A63B 5/11 482/27
2014/0251557 A1 9/2014 Stender et al.
2014/0259930 A1 * 9/2014 Gilliam ..... E01F 13/048 49/70
2014/0352085 A1 * 12/2014 Larson ..... B64F 1/305 14/71.1
2015/0047265 A1 * 2/2015 Morrone, III ..... E06B 9/063 49/506
2015/0089873 A1 * 4/2015 Marsden ..... E06B 9/02 49/56
2015/0101253 A1 * 4/2015 Marsden ..... E05C 19/003 49/386
2015/0208843 A1 * 7/2015 Ruble ..... A47H 13/02 24/373
2015/0267463 A1 * 9/2015 Yager Grad ..... E06B 9/06 49/465
2015/0330126 A1 * 11/2015 Ma ..... E05B 53/003 292/32
2016/0160513 A1 * 6/2016 Singh ..... E04G 1/152 182/113
2016/0348416 A1 12/2016 Curci
2016/0362934 A1 * 12/2016 Swafford ..... E05D 5/06
2017/0067284 A1 * 3/2017 Wang ..... E06B 9/02
2018/0250570 A1 * 9/2018 Yarborough ..... A63B 69/0002
2018/0334849 A1 * 11/2018 Walling ..... E06B 9/0623
2019/0003250 A1 * 1/2019 Flannery ..... E06B 9/06

* cited by examiner

RETRACTABLE GATE SYSTEM

BACKGROUND

The present disclosure relates generally to gate systems, and more specifically to retractable gate systems that enable amusement park guests to enter and exit a queue.

Most amusement parks include attractions that appeal to the interests of a wide variety of audiences of park guests. The attractions include animated characters, amusement park rides, live shows, televised shows, roller coasters, and water slides, among various other amusement park attractions. During peak times (e.g., weekends, national holidays, and/or grand openings of new attractions), park guests may wait in a queue for a long period of time to engage with the amusement park attractions. In some cases, the path of the queue is not always well defined, causing confusion as to where the line begins and/or ends. For example, the path of the queue may be defined by cones that may be easily removed or a chain that may be easily crossed, compromising the integrity of the queue. In some cases, the gate defining the path of the queue may include a swing gate that may swing into the travel path of guests, thereby preventing them from entering and exiting the queue quickly, and/or compromising the speed at which guests can enter and exit the queue.

It may be beneficial to enhance the efficiency by which park guests identify the path of the queue, the speed at which park guests enter, exit, and/or pass through the queue, or the integrity of the queue to block people from jumping spots in line. Accordingly, it is now recognized that it is desirable to provide a gate system that may enhance the efficiency by which park guests enter and/or exit a queue leading to an amusement park attraction, while preserving the integrity of the queue (e.g., by making jumping a spot in line more difficult).

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a gate system includes a first fixed support structure that includes a plurality of fixed rails defining respective passageways and a gate that moves relative to the fixed support structure between an open position and a closed position. The gate includes a plurality of gate rails that slide within the respective passageways as the gate moves between the open position and the closed position. Furthermore, the gate includes one or more compressible sheets coupled to the plurality of gate rails, wherein the one or more compressible sheets are configured to move from a compressed position to an expanded position as the gate moves from the open position to the closed position.

In an embodiment, a gate system includes a first fixed support structure that includes a plurality of fixed rails defining respective passageways and a gate that moves relative to the first fixed support structure between an open position and a closed position. The gate includes a plurality of gate rails that slide within the respective passageways as the gate moves between the open position and the closed position. Furthermore, the gate system includes one or more compressible sheets coupled to the plurality of gate rails, one or more biasing members that bias the gate toward the open position, and a locking member coupled to a second fixed support structure, such that the locking member maintains the gate in the closed position while the locking member is in a locked position.

In an embodiment, a gate system includes a plurality of gates that define a queue path for a line of amusement park guests. Each gate of the plurality of gates moves relative to a corresponding fixed support structure between an open position and a closed position, and each gate of the plurality of gates includes a plurality of gate rails that slide within a respective passageway of the corresponding fixed support structure. Furthermore, the gate system includes a plurality of biasing members, and each biasing member of the plurality of biasing members biases a respective gate of the plurality of gates toward the open position. Furthermore, the gate system includes a plurality of locking members, wherein each locking member of the plurality of locking members, while in a locked position, maintains the respective gate in the closed position.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Typically, amusement parks experience a large amount of guest traffic, especially during peak times. As such, park guests may spend a large portion of their time waiting in a line, hereinafter called a "queue," before engaging with the amusement park attraction. Amusement park attractions may include roller coaster rides, water slides, digital media showings, interactive shows, among various other attractions. In an embodiment, the queue leading up to the amusement park attraction may follow a path defined by chains, removable cones, rope or other features. Furthermore, in an embodiment, gates that allow for the ingress and/or egress of guests may be inserted, but the gates may be hinged and may swing open, interfering with the path of travel of some guests. As such, it may be beneficial to enhance the efficiency by which park guests enter and/or exit the queue.

The disclosed gate system may effectively define a path for guests and may efficiently adjust between open and closed positions. Although the presently disclosed subject matter describes a gate system in an amusement park setting, it should be noted that the gate system described herein may be applied to any environment that may experience queues and/or that may benefit from the use of a gate. As such, the subject matter disclosed herein may be applied to restaurants, concert venues, banks, shopping centers, universities, cafeterias, and the like.

Figure 1:
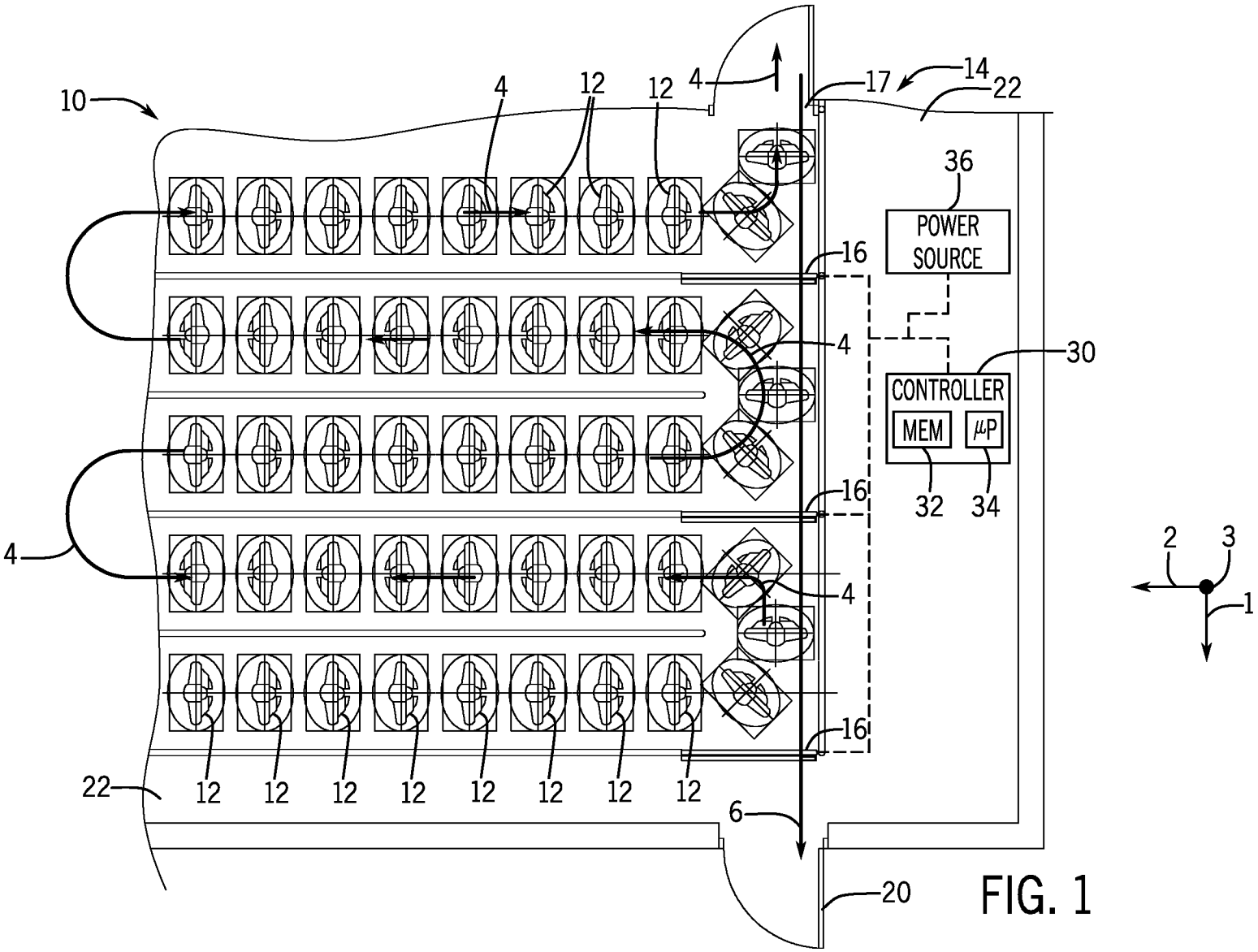
FIG. 1 depicts a plan view of park guests traveling along a queue path defined by a gate system, in accordance with aspects of the present disclosure.

FIG. 1 depicts a plan view of a queue 10 of park guests 12 traveling along a queue path 4 defined by a gate system 14, in accordance with aspects of the present disclosure. The illustrated embodiment includes park guests 12 that may wait in the queue 10 before engaging with a park attraction by passing through a park attraction entrance 17. To facilitate discussion, the queue 10, the gate system 14, and other components may be described with reference to a coordinate system that includes a forward direction 1, a lateral direction 2, and a vertical direction 3. While waiting in the queue 10, as illustrated, the park guests 12 in the queue 10 may follow a winding (e.g., snake-like, zig-zagging, turning) path such that the queue path 4 winds left and right. It should be appreciated that the queue path 4 may have any configuration.

In an embodiment, the gate system 14 may enable park guests 12 to access and efficiently exit the queue 10 through a queue exit 20. As shown, the gate system 14 may include gates 16 that slide along the lateral direction 2 between an open position, allowing park guests 12 to pass, and a closed position blocking park guests 12 from passing. In the closed position, the gates 16 may further define the queue path 4. The gate system 14 in the open position is described in detail below with regards to the description of FIG. 5. The gate system 14 in the closed position is described in detail below with regards to the description of FIG. 4.

In an embodiment, the illustrated gates 16 may all be in the open position, thereby defining a path 6 (e.g., exit path) along the forward direction 1, which may enable the park guests 12 in the queue 10 to quickly exit the queue 10 via the queue exit 20. For example, when the park attraction associated with the queue 10 stops operation or shuts down, the park guests 12 may want to quickly exit the queue 10. Instead of following the queue path 4, which may be long, the park guests 12 may follow the path 6 along the forward direction 1 when the gates 16 are in the open position to efficiently exit the queue 10.

The illustrated embodiment includes an attendant lane 22 positioned on a portion of the perimeter formed by the area of the queue 10. In an embodiment, the attendant lane 22 may be separated from the queue 10 via a wall. In addition, the wall may include windows that allow the park attendants to monitor the queue 10 from the attendant lane 22. In an embodiment, a controller 30 that may control the gate system 14 is positioned in the attendant lane 22. In an embodiment, the park attendants in the attendant lane 22 may send instructions (e.g., via a user interface of the controller 30 or communicatively coupled to the controller 30, such as wirelessly coupled to the controller 30) that the controller 30 may process to actuate the gates 16 of the gate system 14. For example, the park attendants may send instructions to change the gates 16 from an open position to a closed position. It should be appreciated that the controller 30 may be positioned in any of a variety of locations proximate to or remote from the gates 16. Furthermore, the controller 30 may receive various inputs that may be used to control the gates 16, such as inputs from one or more sensors (e.g., signals from rain or wind sensors indicating that the ride will be shut down, or any other suitable sensors that provide signals indicative of a status or condition of the queue path 4, an attraction, environment, or the amusement park).

In an embodiment, the controller 30 includes a processor 34 (e.g., a microprocessor) and a memory 32. The processor 34 may be used to execute software (e.g., stored in the memory 32), such as software for controlling the gate system 14. Moreover, the processor 34 may include multiple microprocessors, one or more general-purpose microprocessors, one or more special-purpose microprocessors, and/or one or more application specific integrated circuits (ASICS), or some combination thereof. For example, the processor 34 may include one or more reduced instruction set (RISC) processors.

The memory 32 may include a volatile memory device, such as random access memory (RAM), and/or a nonvolatile memory, such as read-only memory (ROM). The memory 32 may store a variety of information and may be used for various purposes. For example, the memory 32 may store processor-executable instructions (e.g., firmware or software) for the processor 34 to execute, such as instructions for controlling the gate system 14. The memory 32 (e.g., nonvolatile storage) may include ROM, flash memory, a hard drive, or any other suitable optical, magnetic, or solid-state storage medium, or a combination thereof. The memory 32 may store data (e.g., image data and audio data), instructions (e.g., software or firmware for controlling the gate system 14), and any other suitable data.

Furthermore, the illustrated embodiment includes a power source 36 that may be communicatively coupled to the controller 30 and may regulate power output to the gate system 14. The power source 36 may be any suitable device capable of supplying the power necessary to move the gate 16 between a closed and open position. For example, the power source 36 may be a battery (e.g., lead-acid and/or lithium), an electric generator, and the like, such that the power (e.g., electric power) is transferred to the gate system 14 via an alternating current (AC) power plug or socket. In an embodiment, the position of the gate 16 may be adjusted (e.g., between a closed position and an open position) based on regulating the power output of the power source 36 via the controller 30.

Figure 2:
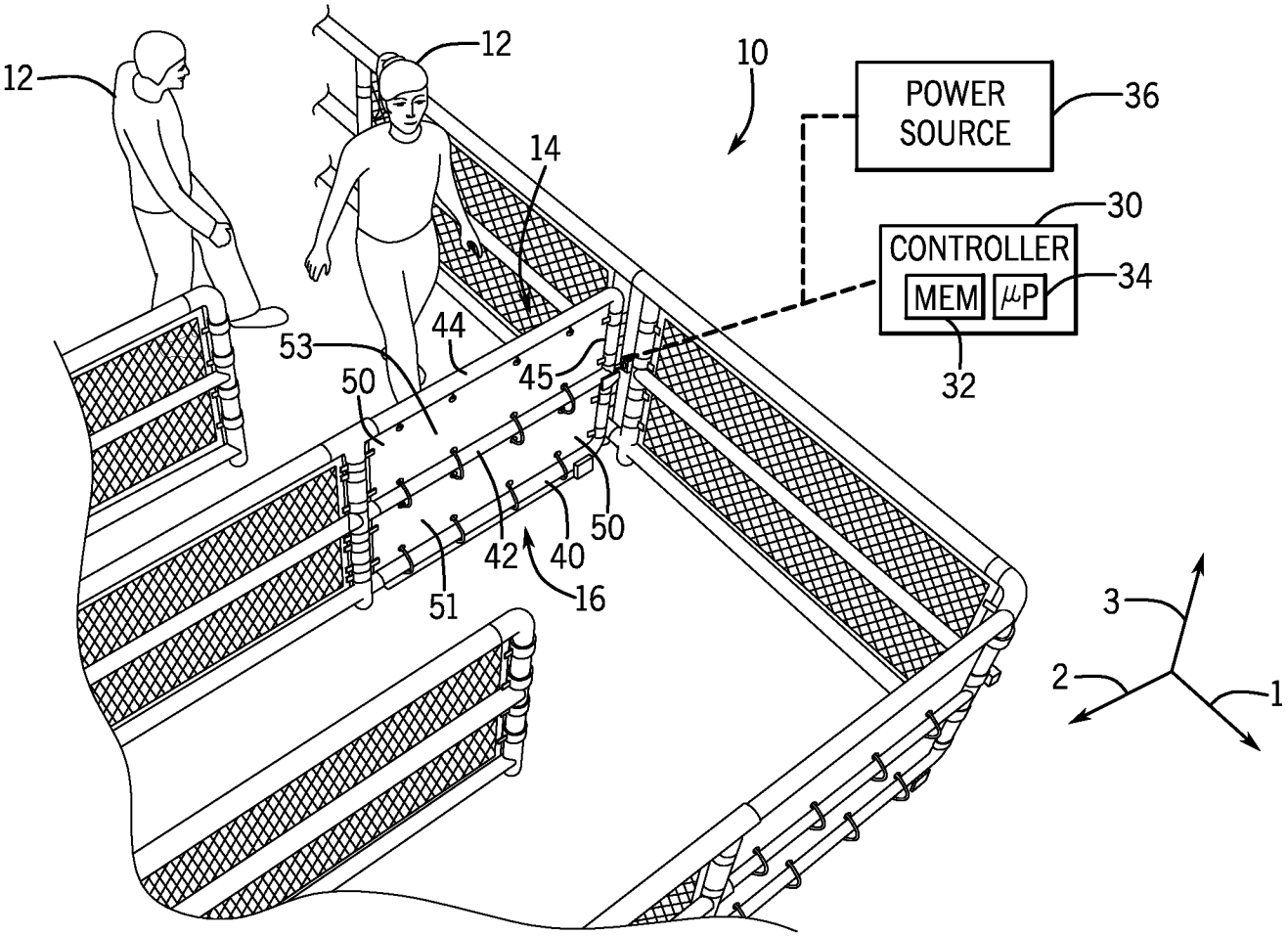
FIG. 2 depicts a perspective view of an embodiment of the park guests traveling along the queue path defined by the gate system of FIG. 1, in accordance with aspects of the present disclosure.

FIG. 2 depicts a perspective view of an embodiment of the park guests 12 traveling along the queue path 4 defined by the gate system 14 of FIG. 1, in accordance with aspects of the present disclosure. The illustrated embodiment includes the gate system 14 in a closed configuration. That is, the gate system 14 defines the queue path 4 by blocking park guests 12 from traveling through the gate 16 or continuing along the forward direction 1, and shifts the direction of the queue path 4 towards the lateral direction 2.

As illustrated, the gate system 14 includes a first gate rail 40, a second gate rail 42, and a third gate rail 44, and hereinafter collectively called "gate rails." The gate rails 40, 42, and 44 are each oriented substantially parallel to the floor along the lateral direction 2. The gate rails 40, 42, and 44 collectively span a plane that forms the general shape of the gate 16. Furthermore, the gate rails 40, 42, and 44 may be formed of materials such as steel, aluminum, iron, plastic and/or the like. Although the illustrated embodiment includes three gate rails, in an embodiment, the gate 16 may include any number of gate rails. For example, the gate 16 may include two, four, six, eight, ten, twenty, or any number of gate rails. As shown, the gate 16 includes a vertical support beam 45 coupled to the gate rails 40, 42, and 44.

With the following in mind, the illustrated embodiment includes compressible sheets 50 (e.g., foldable sheets or panels) that are positioned in the respective gaps formed by the vertical distance (e.g., distance along the vertical direction 3) between any two sequentially spaced gate rails. For example, the illustrated embodiment includes a first compressible sheet 51 between the first gate rail 40 and the second gate rail 42. In addition, the illustrated embodiment includes a second compressible sheet 53 between the second gate rail 42 and the third gate rail 44. In an embodiment, there may be more compressible sheets 50, if the gate 16 includes more gate rails. For example, if the gate 16 includes five gate rails oriented along the lateral direction 2, parallel to the floor, and separated from other gate rails by a corresponding vertical distance, the gate 16 may include four compressible sheets 50. In an embodiment, no compressible sheets 50 are included (e.g., the gate 16 is devoid of compressible sheets 50).

In an embodiment, the gate 16 may include gaps between any two gate rails that do not include the compressible sheets 50. For example, instead of including the compressible sheet 51 between the first gate rail 40 and the second gate rail 42, and the second compressible sheet 53 between the second gate rail 42 and the third gate rail 44, the gate 16 may include only the compressible sheet 50 between the first gate rail 40 and the second gate rail 42. As such, there may be an open gap (e.g., the compressible sheet 50 may be omitted) between the second gate rail 42 and the third gate rail 44.

In an embodiment, the controller 30 may execute, via the processor 34, instructions stored in the memory 32 that cause the gate 16 to move between a closed and open position by, for example, regulating the power source 36. The compressible sheet 50 may move (e.g., translate, fold, and/or compress) as the gate rails 40, 42, and 44 move between an open and closed position. As such, the compressible sheets 50 may be of any material that may compress along the lateral direction 2 (e.g., when the gate system 14 moves from a closed position to an open position). For example, in an embodiment, the compressible sheet 50 may be made of nylon, cotton, polypropylene (PP), polyester (PET), or any combination thereof. In an embodiment, the compressible sheets 50 may be made out of a substantially water resistant or waterproof material such as a tarpaulin, which may further include a cloth (e.g., such as a canvas or polyester) coated with urethane or made of plastics such as polyethylene. Further, the compressible sheets 50 may include a woven material that is made of any suitable polymers conducive to compressing along the lateral direction 2.

Figure 3:
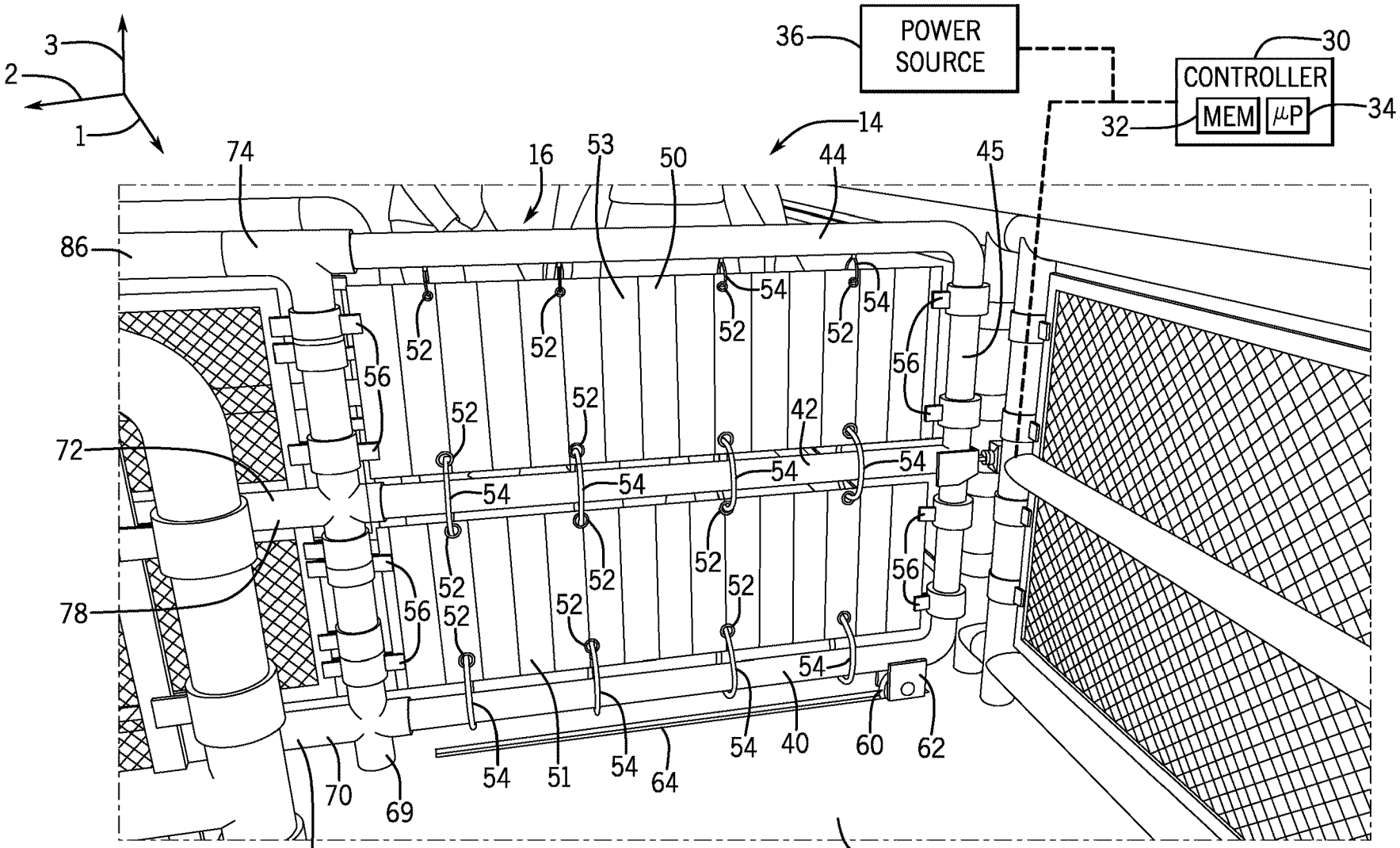
FIG. 3 depicts a front perspective view of an embodiment of the gate system of FIG. 1, in accordance with aspects of the present disclosure.

Turning to FIG. 3, depicted is a front perspective view of an embodiment of the gate system 14, in accordance with aspects of the present disclosure. The illustrated embodiment includes the gate rails 40, 42, and 44 mentioned above with the compressible sheets 50 in the vertical gaps formed by the gate rails. Furthermore, the illustrated embodiment includes compressible sheets 50 with sheet openings 52 (e.g., holes) that may receive a clasp 54 (e.g., clip, ring, annular or c-shaped structure) that may loop around the circumference of a respective gate rail. In an embodiment, the sheet openings 52 may include a respective metallic element (e.g., grommet) tracing the perimeter of each of the sheet openings 52 to prevent tearing of the compressible sheets 50 due to the clasp 54 engaging with the sheet openings 52.

Furthermore, the clasps 54 may couple the set of compressible sheets 50 to each other along the vertical direction 3 by engaging with the sheet openings 52 of the respective compressible sheets 50. For example, the illustrated embodiment includes clasps 54 that are positioned around the circumference of the second gate rail 42 and that engage with the sheet openings 52 corresponding to the first and second compressible sheets 51 and 53 (e.g., the compressible sheet above and below the second gate rail 42). In an embodiment, the clasps 54 may be of any other material (e.g., plastic). The clasps 54 may couple the gate rail to the sheet openings 52 of the respective compressible sheets 50. For example, as illustrated, the third gate rail 44 includes four clasps 54 that, instead of looping around the circumference of the third gate rail 44, are coupled to the inside of the third gate rail 44.

In an embodiment, the compressible sheets 50 may include clips 56 that may couple the compressible sheets 50 to the perimeter of the gate 16. In the illustrated embodiment, these clips 56 laterally engage the compressible sheets 50 (e.g., engage a lateral edge of the compressible sheets 50). In an embodiment, the clips 56 may maintain the compressible sheets 50 in an expanded position and block the compressible sheets 50 from sliding along respective gate rails 40, 42, and 44 while the gate 16 is in the closed position.

The illustrated embodiment of the gate system 14 includes a wheel 60 with a protective member 62 (e.g., bracket), such that the wheel 60 may roll along a linear opening 64 in a floor 66. In other embodiments, the gate system 14 may include any number of the wheels 60 or rolling members to facilitate the movement of the gate 16 along the lateral direction 2. For example, the gate system 14 may include two, four, six, ten, or any suitable number of wheels, rolling members, and/or sliding members that may facilitate the movement of the gate 16 along the lateral direction 2. As illustrated, the wheel 60 is coupled to the first gate rail 40, and the wheel 60 may roll along the lateral direction 2 to facilitate the movement of the gate 16 along the lateral direction 2 from the closed position to the open position.

That is, the wheel 60 may facilitate the movement of the gate 16 and its gate rails 40, 42, and 44 along the lateral direction 2, such that when the gate 16 moves along the lateral direction 2 from a closed position (e.g., as illustrated in FIG. 3) to the open position, the first, second, and third gate rails 40, 42, and 44 may each slide into respective fixed rails defining respective passageways. The illustrated embodiment includes a first fixed support structure 69 that includes a first fixed rail 70 defining a first passageway 76, a second fixed rail 72 defining a second passageway 78, and a third fixed rail 74 defining a third passageway 86. The first passageway 76 is configured to receive the first gate rail 40, the second passageway 78 is configured to receive the second gate rail 42, and the third passageway 86 is configured to receive the third gate rail 44 when the gate 16 moves from the closed position to the open position.

While the illustrated gate system 14 includes one gate, in an embodiment, the gate system 14 may include gates 16 that may each slide into respective fixed rails 70, 72, and 74 along the lateral direction 2. In an embodiment, the respective fixed rails 70, 72, and 74 may define respective passageways 76, 78, and 86 that receive the respective gate 16, thereby allowing the gates 16 to slide from the closed position to the open position. Such a configuration may provide a compact gate system 14 that does not interfere in travel through the queue 10 and/or exit from the queue 10 (e.g., the gate(s) 16 do not rotate or swing into the path of the park guests 12).

Figure 4:
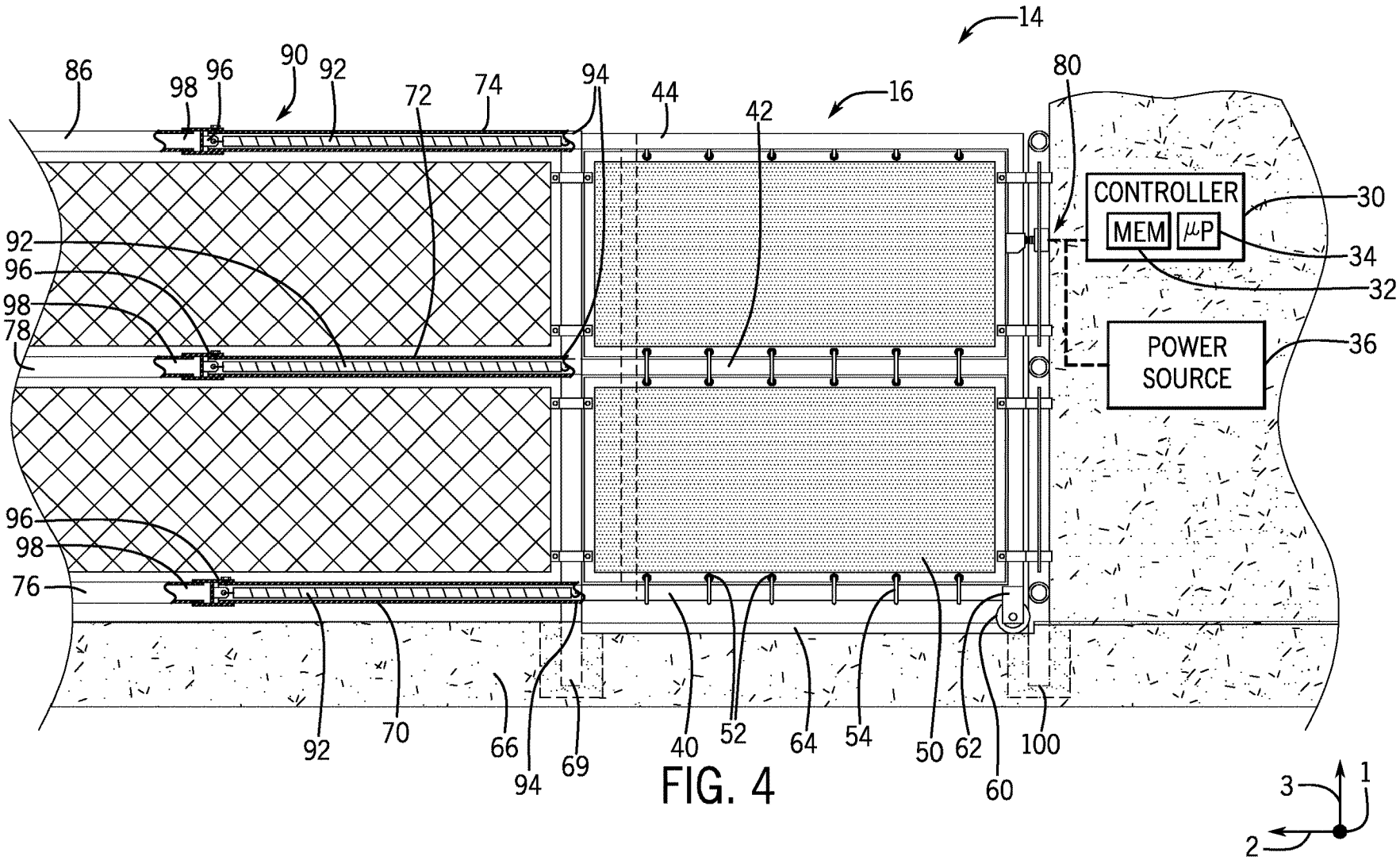
FIG. 4 depicts an elevation and cross-sectional view of an embodiment of the gate system of FIG. 1 in a closed position, in accordance with aspects of the present disclosure.

FIG. 4 depicts an elevation and cross-sectional view of an embodiment of the gate system 14 of FIG. 1 in the closed position, in accordance with aspects of the present disclosure. The illustrated embodiment includes the gate 16, which includes the first gate rail 40, the second gate rail 42, and the third gate rail 44 that may be configured to move along the lateral direction 2, such that the gate rails 40, 42, and 44 may slide into respective passageways 76, 78, and 86, defined by the corresponding fixed rails 70, 72, and 74. The corresponding fixed rails 70, 72, and 74 are each positioned substantially parallel to the floor 66 and each abut the first fixed support structure 69 (e.g., fixed relative to the floor 66). The wheel 60 may roll along the linear opening 64 on the floor 66 to facilitate the movement of the gate 16 from the closed position to the open position and/or from the open position to the closed position along the lateral direction 2. In an embodiment, these linear openings 64 may be curved with respect to the curved (or flexible) gate rails 40, 42, and 44, and curved passageways 76, 78, and 86. As mentioned above, the controller 30 may execute, via the processor 34, instructions stored in the memory 32 to change the gate system 14 between the closed and open positions. In an embodiment, changing the gate system 14 between the closed and open positions may include regulating the power source 36.

Furthermore, the illustrated embodiment includes a locking member 80 (e.g., lock), which may exert a force opposite of the illustrated lateral direction 2 to maintain the gate system 14 in the closed position. The locking member 80 may be an electromagnetic lock that may receive a supply of current (e.g., alternating current at a suitable frequency) via the power source 36, as discussed in more detail below. In an embodiment, the magnitude of the force that the electromagnetic lock may exert is related to the current supplied by the power source 36. For example, the higher the magnitude of the current supplied by the power source 36 to the locking member 80 (e.g., the electromagnetic lock), the higher the magnitude of the force exerted by the locking member 80 on the gate 16 in the direction opposite of the lateral direction 2.

The locking member 80 may have any suitable configuration. For example, the locking member 80 may be a latch system that includes a hook on the gate 16 that may engage with a hook opening on a second fixed support structure 100. As such, when the gate system 14 is in the closed position, the hook on the gate 16 may couple to an opening on the illustrated second fixed support structure 100, such that the gate system 14 remains in the closed position (e.g., as illustrated in FIG. 4). The hook may be manually operated and/or controlled by the controller 30 to unlatch from the opening to enable the gate system 14 to move from the closed position to the open position. It should be noted that the gate system 14 may include any number of locking members 80 on the second fixed support structure 100. For example, although the illustrated embodiment includes one locking member 80, in further embodiments, the gate system 14 may include two, four, six, ten, or any suitable number of locking members 80. As such, in an embodiment, the locking members 80 may all be electromagnetic locks that may each be communicatively coupled to the controller 30 and the power source 36, such that they may independently receive the same current supply. Thus, some or all of the locking members 80 may be actuated simultaneously via the controller 30, thereby quickly adjusting or providing a path for guests. In an embodiment, the locking members 80 may each exert the same force or in another embodiment, the locking members 80 may exert different forces (e.g., based on the power/current delivered from the power source 36 and regulated by the controller 30).

Furthermore, the illustrated embodiment includes a biasing system 90 that may couple to one or more gate rails 40, 42, and 44 via a first coupling element 94. More specifically, in the illustrated embodiment, the first passageway 76 of the first fixed rail 70, the second passageway 78 of the second fixed rail 72, and the third passageway 86 of the third fixed rail 74 each include a respective biasing member 92. The biasing member 92 includes the first coupling element 94 and a second coupling element 96. In the illustrated embodiment, the first and second coupling elements 94 and 96 may be any suitable coupling elements such as a hook and latch system, chains, weldments, and the like. In more detail, the first coupling element 94 couples the biasing member 92 to the respective gate rail 40, 42, and/or 44. Furthermore, the second coupling element 96 couples the biasing member 92 to a fixed passageway structure 98 (e.g., fixed relative to the floor 66). In an embodiment, the fixed passageway structure 98 may be positioned inside the passageway formed by a fixed rail, may be a fixed rail, or may be a wall, such that the second coupling element 96 engages directly with the wall to couple the wall to the biasing member 92. It should be noted that while the illustrated embodiment includes the biasing member 92 corresponding to each fixed rail 70, 72, and 74, in an embodiment, some fixed rails include biasing members, while others do not.

The illustrated embodiment includes a spring as the biasing member 92, such that when the gate system 14 is in the closed position, the spring is stretched because the spring is fixed to the fixed passageway structure 98 and the gate 16. Therefore, the biasing member 92 exerts a force (e.g., according to Hooke's law) that may drive the gate 16 into the open position discussed below with regards to FIG. 5, when there is not a force from the locking member 80 counteracting the force of the biasing member 92. When the gate 16 is in the illustrated closed position, the spring (e.g., biasing member 92) may be extended. In alternative embodiments, the biasing member 92 may include a hydraulic actuator, a pneumatic actuator, or any combination thereof.

In an embodiment, the locking member 80 may exert a force opposite of the force exerted by the biasing member 92. In an embodiment, the force exerted by the locking member 80 (e.g., in the direction opposite of the illustrated lateral direction 2) may be greater than the force (e.g., along the lateral direction 2) exerted by the biasing member 92, such that the gate system 14 remains in the closed position, as illustrated in FIG. 4.

Furthermore, the illustrated embodiment includes the compressible sheets 50 that are uncompressed (e.g., unfolded and/or extended) when the gate system 14 is in the closed position. Furthermore, when the gate system 14 is in the closed position, the gate 16 is positioned to abut the locking member 80 or the second fixed support structure 100. As mentioned above, when the gate system 14 is in the closed position, the force exerted by the locking member 80 may be in the opposite direction and greater than the force exerted by the biasing member 92 of the biasing system 90.

Figure 5:
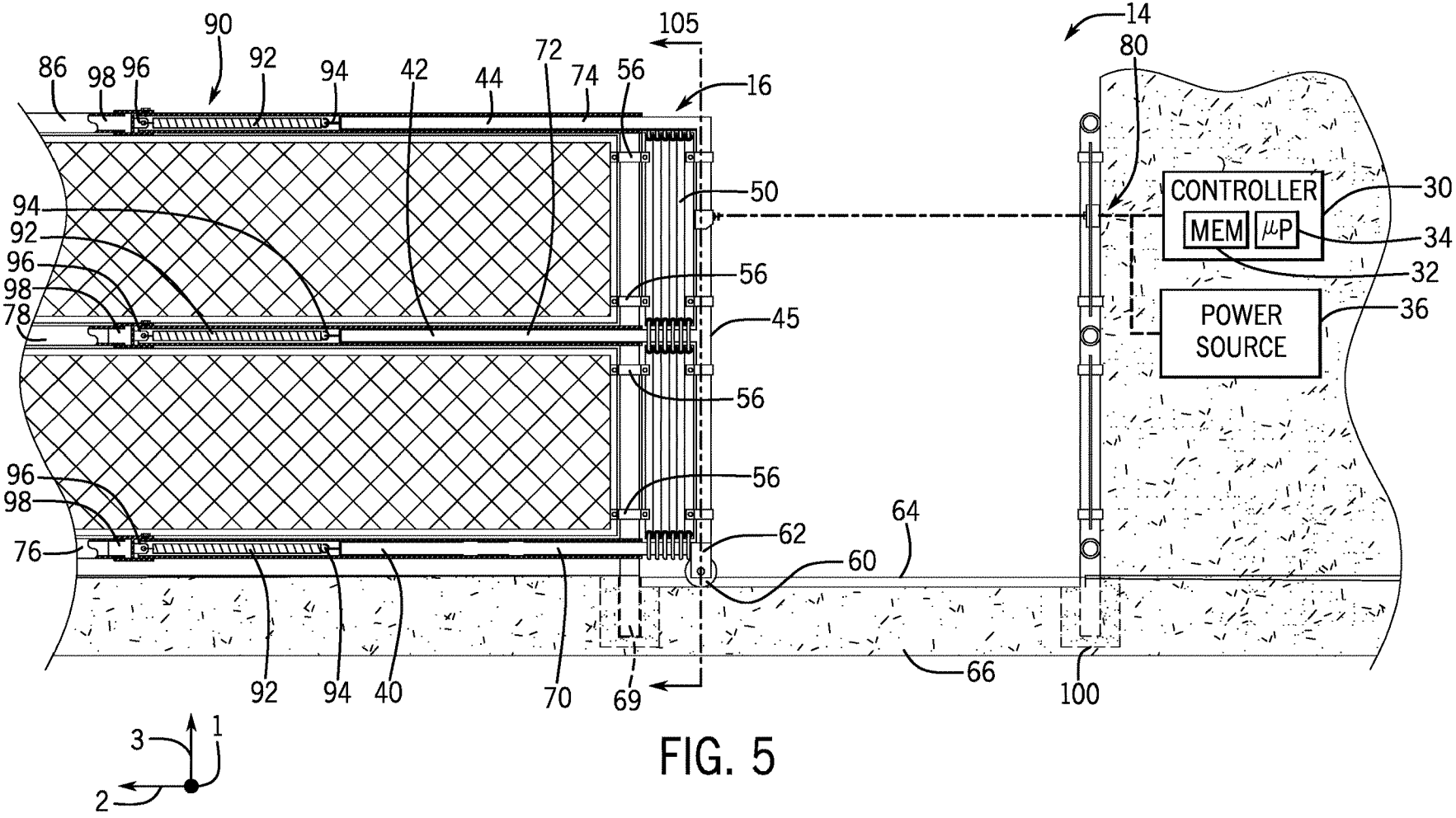
FIG. 5 depicts an elevation and cross-sectional view of an embodiment of the gate system of FIG. 1 in an open position, in accordance with aspects of the present disclosure.

Turning to FIG. 5, depicted is an elevation and cross-sectional view of an embodiment of the gate system 14 of FIG. 1 in the open position, in accordance with aspects of the present disclosure. That is, while FIG. 4 illustrates the gate system 14 in the closed position, FIG. 5 illustrates the gate system 14 in the open position. The gate system 14 may move from a closed position to the illustrated open position in response to a control signal from the processor 34 of the controller 30. For example, the processor 34 may execute instructions stored in the memory 32 to reduce or block the current delivered from the power source 36 to the locking member 80, thereby causing the locking member 80 to move from a locked position to an unlocked position and enabling the biasing system 90 to drive the gate 16 to the open position. Similar to the embodiment illustrated in FIG. 4, FIG. 5 illustrates the gate system 14 including the gate 16 having the first gate rail 40 configured to slide into the first passageway 76 of the first fixed rail 70, the second gate rail 42 arranged to slide into the second passageway 78 of the second fixed rail 72, and the third gate rail 44 configured to slide into the third passageway 86 of the third fixed rail 74. The gate system 14 may include the first fixed support structure 69 and the second fixed support structure 100, such that the second fixed support structure 100 includes the locking member 80 (e.g., electromagnetic lock). Furthermore, the wheel 60 of the gate system may facilitate the movement of the gate 16 from the closed to open position (and from the open to closed position), by rolling along the linear opening 64 in the floor 66.

Furthermore, the illustrated embodiment includes the biasing system 90 that biases the gate 16 toward the open position. The biasing system 90 includes the biasing members 92, the respective first coupling elements 94 that couples corresponding biasing members 92 to the corresponding gate rail 40, 42, and/or 44, the respective second coupling elements 96 that couple the corresponding biasing members 92 to the fixed passageway structure 98. As mentioned above, in an embodiment the biasing member 92 may be a spring, such that a force is always applied to the gate rails 40, 42, and/or 44 when the spring is extended (e.g., when the gate 16 is not in the illustrated open position). When the gate 16 is in the illustrated open position, the spring (e.g., biasing member 92) may be compressed (e.g., retracted).

When the gate 16 transitions from the closed position to the open position, the gate rails 40, 42, and 44 may slide along the lateral direction 2 into their respective passageways 76, 78, and 86, defined by corresponding fixed rails 70, 72, and 74. This motion is facilitated by the wheel(s) 60. Furthermore, when the gate 16 is in the open position, the compressible sheets 50 are compressed (e.g., folded) along the direction of movement (e.g., the lateral direction 2). In an embodiment, the compressible sheets 50 may include the clips 56 that may couple the compressible sheets 50 to the vertical support beam 45 of the gate 16 and the first fixed support structure 69. In an embodiment, the clips 56 may prevent the compressible sheet from sliding along respective gate rails 40, 42, and 44 while the gate 16 is in the open position.

Figure 6:
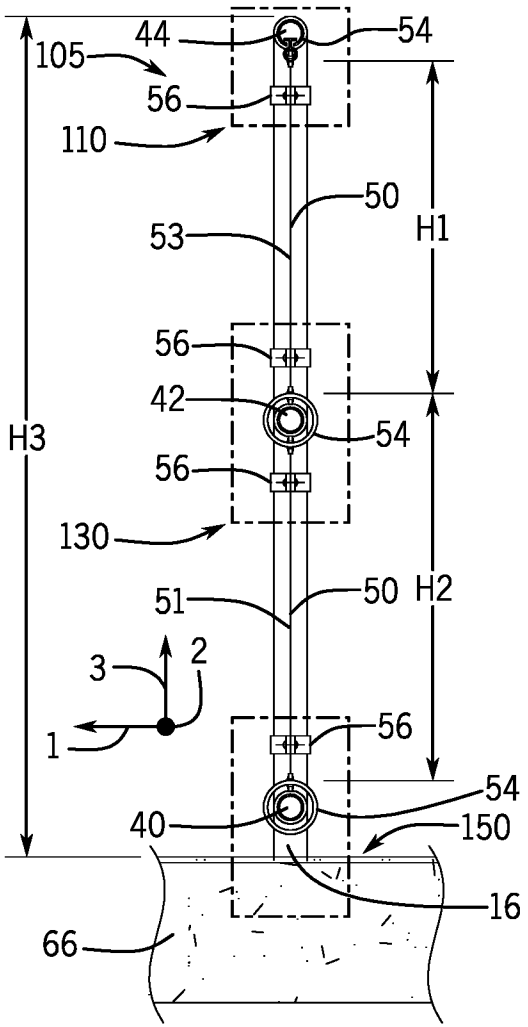
FIG. 6 depicts a cross-sectional side view of an embodiment of a gate of the gate system of FIG. 1, in accordance with aspects of the present disclosure.

FIG. 6 depicts a cross-sectional side view 105 of an embodiment of the gate 16 of the gate system 14 of FIG. 1, in accordance with aspects of the present disclosure. The illustrated embodiment includes the same coordinate system described in the previously discussed figures. More specifically, the illustrated embodiment includes a top portion 110 that includes the third gate rail 44, the clip 56, and the clasp 54 that loops around the third gate rail 44 and couples the third gate rail 44 to the first compressible sheet 51. Furthermore, the illustrated embodiment includes a middle portion 130 that includes the second gate rail 42, clips 56, and the clasp 54 that loops around the second gate rail 42 and couples the second gate rail 42 to the first and second compressible sheets 51 and 53. Furthermore, the illustrated embodiment includes a lower portion 150 that includes the first gate rail 40, the clip 56, and the clasp 54 that loops around the first gate rail 40 and couples the first gate rail 40 to the second compressible sheet 53. It should be noted that while the illustrated embodiment only includes four clips 56 the gate system 14 may include any number of clips 56, such as two, six, ten, fifteen, twenty, and the like. While the illustrated embodiment includes clips 56 that laterally engage with the compressible sheets 50, in an embodiment, the clips 56 may vertically and/or longitudinally engage with the compressible sheets 50 (e.g., engage an upper or lower edge of the compressible sheets 50).

Furthermore, the second compressible sheet 53 between the third gate rail 44 and the second gate rail 42 has a height of H1. The first compressible sheet 51 between the first gate rail 40 and the second gate rail 42 has a height of H2. It should be noted that, in an embodiment, H1 may be the same as H2, while in other embodiments, H1 and H2 may differ. Furthermore, in an embodiment, H1 may also be the distance between the third gate rail 44 and the second gate rail 42. As such, H2 may also be the distance between the first gate rail 40 and the second gate rail 42. Furthermore, the height of the gate 16 H3 may be any suitable height from the floor 66.

Figure 7:
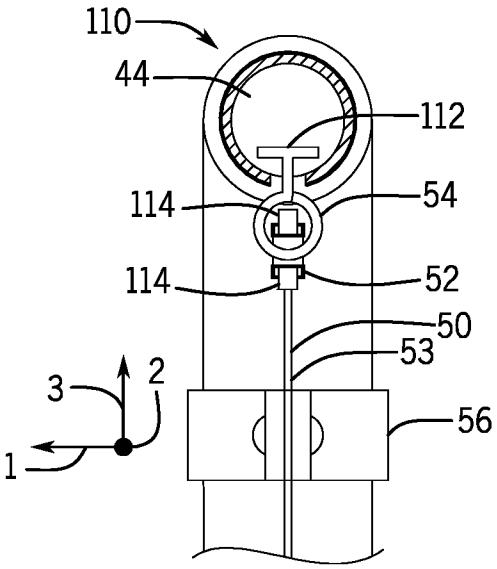
FIG. 7 depicts a cross-sectional side view of an embodiment of a top portion of the cross-sectional view of the gate of FIG. 6, in accordance with aspects of the present disclosure.

FIG. 7 depicts a cross-sectional side view of an embodiment of the top portion 110 of the cross-sectional view of the gate of FIG. 6, in accordance with aspects of the present disclosure. As illustrated, the clasp 54 includes a top T-shaped portion 112 that is positioned inside the third gate rail 44 and engages an inner surface of the third gate rail 44 to couple the clasp 54 to the third gate rail 44. As such, in an embodiment, the clasp 54 may slide along the third gate rail 44.

The illustrated embodiment further depicts a cross-sectional view of the sheet opening 52 that may receive the clasp 54. In more detail, the sheet opening 52 may include a fabric eyelet 114 (e.g., grommet) that traces the circumference of the sheet opening 52. In an embodiment, the fabric eyelet 114 may be of a metallic material that may add strength to the sheet opening 52, thereby increasing the durability of the compressible sheets 50. The illustrated embodiment depicts the clip 56 that may fix the compressible sheets 50 to the perimeter of the gate 16.

Figure 8:
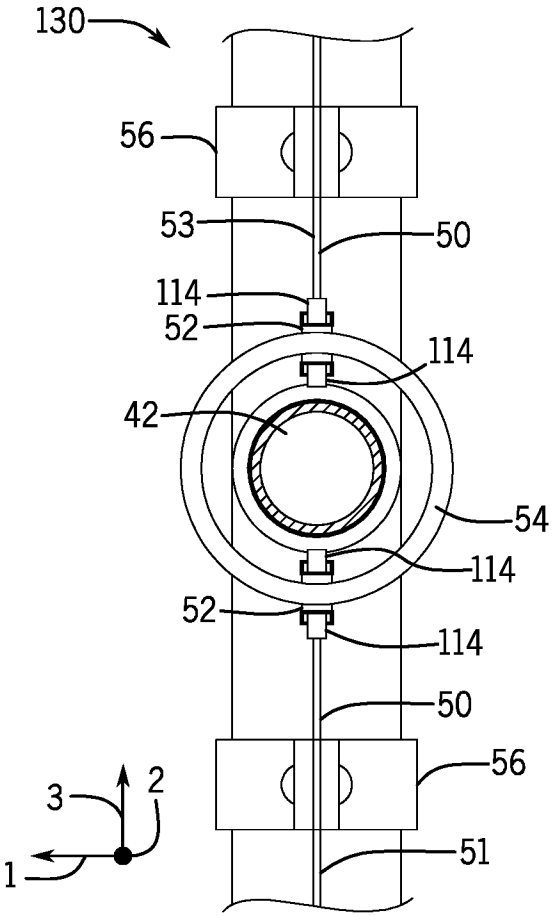
FIG. 8 depicts a cross-sectional view of an embodiment of a middle portion of the cross-sectional view of the gate of FIG. 6, in accordance with aspects of the present disclosure.

FIG. 8 depicts a cross-sectional view of an embodiment of the middle portion 130 of the cross-sectional view of the gate of FIG. 6, in accordance with aspects of the present disclosure. In more detail, the illustrated embodiment includes the second gate rail 42, and the clasp 54 is positioned around the circumference of the second gate rail 42. As described above, the first and second compressible sheets 51 and 53 may include the sheet openings 52 with the fabric eyelet 114 (e.g., grommet) that traces the circumference of the sheet opening 52. Furthermore, the clip(s) 56 may fix the compressible sheet(s) 50 to the gate 16 along the lateral direction 2.

Figure 9:
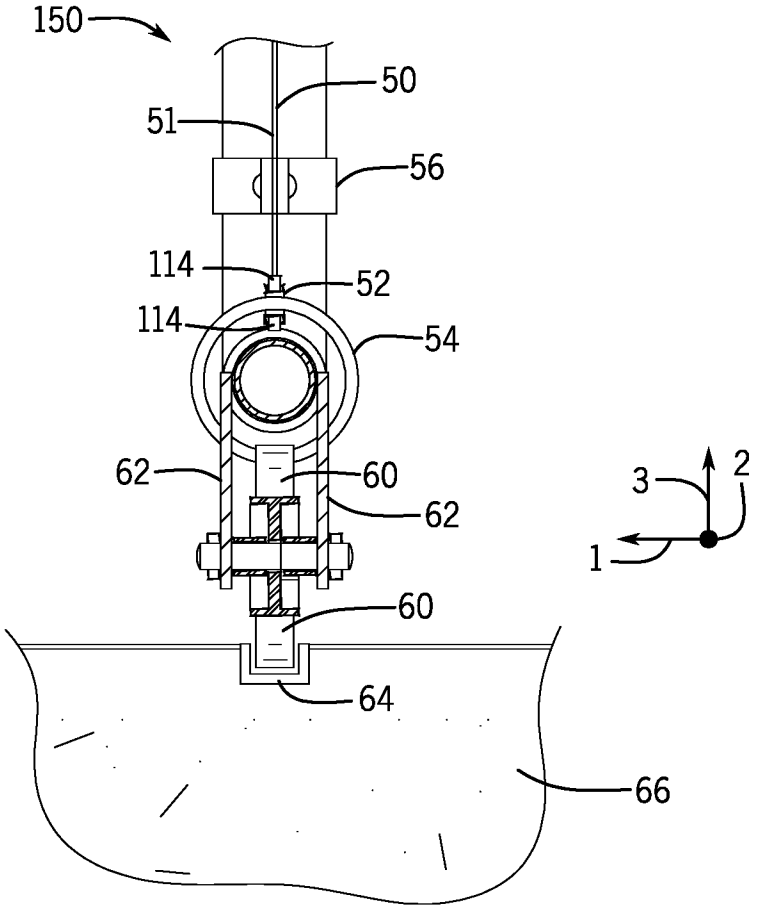
FIG. 9 depicts a cross-sectional view of an embodiment of a lower portion of the cross-sectional view of the gate of FIG. 6, in accordance with aspects of the present disclosure.

FIG. 9 depicts a cross-sectional view of an embodiment of the lower portion 150 of the cross-sectional view of the gate of FIG. 6, in accordance with aspects of the present disclosure. In more detail, the illustrated embodiment includes the compressible sheet 50 fixed along the lateral direction 2 via the clips 56. Furthermore, the compressible sheet 50 includes the sheet opening 52 that may include the fabric eyelet 114 (e.g., grommet) that traces the circumference of the sheet opening 52. The sheet opening 52 may receive the clasp 54 to couple the compressible sheets 50 to the first gate rail 40.

In addition, the illustrated embodiment includes the wheel 60 which may roll along the linear opening 64 to facilitate the movement of the gate 16 from the closed position to the open position. Furthermore, the wheel 60 includes the protective members 62 located forward and behind the wheel 60 along the forward direction 1. Furthermore, the protective members 62 may include openings configured to receive a hub of the wheel 60. It should be noted that in additional embodiment, the wheel 60 may be omitted. In further embodiments, the wheel 60 may be replaced by any element that may facilitate the movement of the gate along the lateral direction 2.

Figure 10:
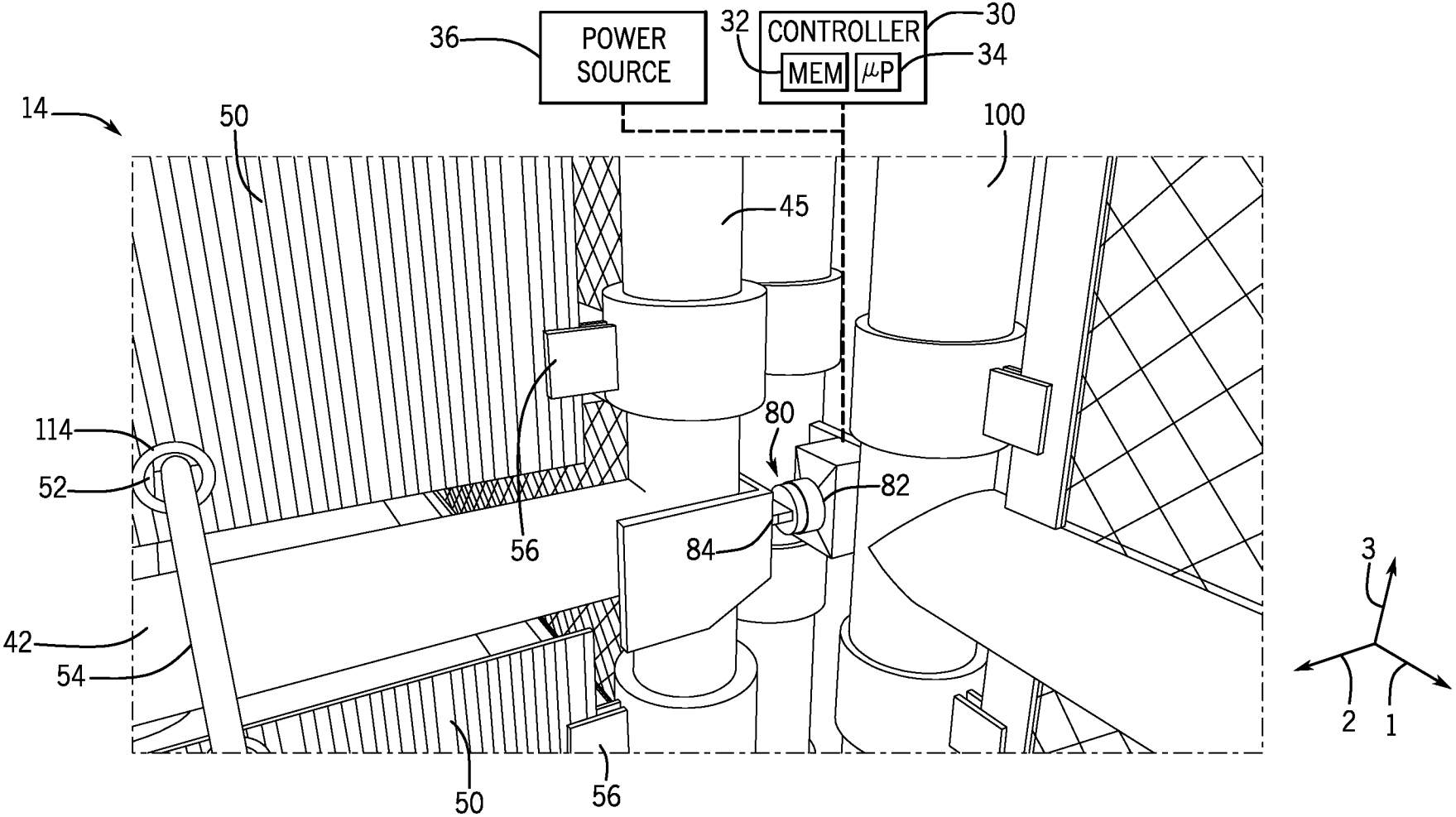
FIG. 10 depicts a perspective view of an embodiment of the locking member of the gate system of FIG. 1, in accordance with aspects of the present disclosure.

FIG. 10 depicts a perspective view of an embodiment of the locking member 80 of the gate system 14 of FIG. 1, in accordance with aspects of the present disclosure. The illustrated embodiment includes the compressible sheets 50 coupled to the second gate rail 42 via the clasp(s) 54 that engage with the compressible sheets 50 via respective sheet openings 52. The sheet openings 52 may include fabric eyelets 114 that may protect the sheet openings from the clasp(s) 54. Furthermore, the compressible sheets 50 are coupled to the vertical support beam 45 via the clips 56.

Further, the illustrated embodiment includes the locking member 80 that is an electromagnetic lock communicatively coupled to the controller 30. The controller 30 includes the processor 34 that may execute instructions stored in the memory 32 to control the position of the gate 16 of the gate system 14. For example, the processor 34 may receive a user input to move the gate 16 from the open position to the closed position. In addition, or alternatively, the controller 30 may execute an automated control scheme to send control signals to the locking member 80 that may control the position of the gate 16 (e.g., between a closed and open position). In an embodiment, the controller 30 may control the current supplied from the power source 36 to the locking member 80.

More specifically, the locking member 80, includes an electromagnetic portion 82 of the electromagnetic lock attached to the second fixed support structure 100 and an armature plate 84 attached to the gate 16. When the gate 16 is in the closed position, as depicted in the current embodiment, the electromagnetic portion 82 (e.g., electromagnet) and the armature plate 84 may be in contact with one another. Alternatively and/or additionally, when the gate 16 is in the open position, the electromagnetic portion 82 (e.g., electromagnet) and the armature plate 84 may not be in contact with one another. Furthermore, when the electromagnetic portion 82 (e.g., electromagnet) is energized (e.g., via the current supply form the power source 36), a current passing through the electromagnetic portion 82 creates a magnetic flux that causes the armature plate 84 to attract the electromagnetic portion 82, creating a force (e.g., locking action) that may hold the gate 16 in the closed position. In an embodiment, the mating area of the electromagnetic portion 82 (e.g., electromagnet) and the armature plate 84 may be relatively large. As such, the force (e.g., locking action) associated with the magnetic flux may be strong enough to keep the gate 16 in the closed position, even under the stress (e.g., axial force) created by the biasing member 92.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A gate system, comprising:

a fixed support structure comprising a plurality of fixed rails defining respective passageways; and a gate configured to move relative to the fixed support structure between an open position and a closed position, wherein the gate comprises:

a plurality of gate rails configured to slide within the respective passageways as the gate moves between the open position and the closed position;

a plurality of compressible sheets coupled to the plurality of gate rails, wherein the plurality of compressible sheets are vertically stacked with respect to one another and configured to move from a compressed position to an expanded position as the gate moves from the open position to the closed position; and a clasp directly coupling a first compressible sheet and a second compressible sheet of the plurality of compressible sheets and circumferentially surrounding a respective gate rail of the plurality of gate rails such that the respective gate rail is configured to move relative to the clasp as the gate moves between the open position and the closed position.

2. The gate system of claim 1, comprising one or more biasing members configured to bias the gate toward the open position.

3. The gate system of claim 1, comprising a plurality of biasing members, wherein each biasing member of the plurality of biasing members is configured to bias the gate toward the open position by exerting an axial force on a first end of the respective gate rail of the plurality of gate rails.

4. The gate system of claim 3, comprising a locking member coupled to an additional fixed support structure and configured to maintain the gate in the closed position while the locking member is in a locked position.

5. The gate system of claim 4, wherein the locking member is an electromagnetic lock comprising an electromagnet positioned on the additional fixed support structure and an armature plate positioned on the gate, wherein the electromagnet is configured to receive a current when the locking member is in the locked position.

6. The gate system of claim 1, wherein a first lateral end of the first compressible sheet is coupled to the fixed support structure and a second lateral end of the first compressible sheet is coupled to a vertical support beam of the gate.

7. The gate system of claim 1, wherein a first gate rail and a second gate rail of the plurality of gate rails are oriented parallel to a floor and are separated from one another by a vertical distance.

8. The gate system of claim 7, wherein the first compressible sheet of the plurality of compressible sheets extends at least partially across a gap defined by the vertical distance.

9. The gate system of claim 1, comprising a wheel fixed to one gate rail of the plurality of gate rails, wherein the wheel is configured to roll along a groove in a floor to facilitate the movement of the gate between the open position and the closed position.

10. A gate system, comprising:

a first fixed support structure comprising a plurality of fixed rails defining respective passageways;

a gate configured to move relative to the first fixed support structure between an open position and a closed position, wherein the gate comprises a plurality of gate rails configured to slide within the respective passageways as the gate moves between the open position and the closed position;

a plurality of compressible sheets, wherein the plurality of compressible sheets are vertically stacked with respect to one another and are coupled to the plurality of gate rails via one or more clasps circumferentially surrounding respective gate rails of the plurality of gate rails, wherein the plurality of gate rails are configured to move relative to the one or more clasps during transition between the open position and the closed position;

a clasp of the one or more clasps directly coupling a first compressible sheet and a second compressible sheet of the plurality of compressible sheets;

one or more biasing members configured to bias the gate toward the open position; and a locking member coupled to a second fixed support structure and configured to maintain the gate in the closed position while the locking member is in a locked position.

11. The gate system of claim 10, wherein the plurality of compressible sheets are configured to move from an expanded position to a compressed position as the gate moves from the closed position to the open position.

12. The gate system of claim 10, wherein the one or more biasing members comprise a spring, a hydraulic actuator, a pneumatic actuator, or any combination thereof.

13. The gate system of claim 10, comprising a controller configured to provide a control signal to adjust the locking member from the locked position to an unlocked position, thereby enabling the one or more biasing members to drive the gate to the open position.

14. The gate system of claim 10, wherein the locking member is an electromagnetic lock configured to default the gate to the closed position.

15. The gate system of claim 14, wherein the locking member comprises an electromagnet positioned on the second fixed support structure and an armature plate positioned on the gate, and the electromagnet is configured to receive a current when the locking member is in the locked position.

16. A gate system, comprising:

a plurality of gates that define a portion of a queue path for a line of amusement park guests, wherein each gate of the plurality of gates is aligned with the others and configured to move relative to a corresponding fixed support structure between an open position and a closed position, wherein each gate of the plurality of gates comprises:

a plurality of gate rails each configured to slide within a respective passageway of the corresponding fixed support structure;

a first compressible sheet and second compressible sheet, wherein the first compressible sheet is vertically stacked with respect to the second compressible sheet; and a clasp directly coupling the first compressible sheet and the second compressible sheet of the plurality of compressible sheets;

a plurality of biasing members, wherein each biasing member of the plurality of biasing members is configured to bias a respective gate of the plurality of gates toward the open position, wherein the queue path is in a linear configuration including a series of linear paths with a transversely aligned exit path through the plurality of gates when the plurality of gates are each in the open position; and a plurality of locking members, wherein each locking member of the plurality of locking members is configured to maintain the respective gate in the closed position while in a locked position, wherein the queue path is in a circuitous configuration when the plurality of gates are in the closed position.

17. The gate system of claim 16, comprising a controller configured to provide a control signal to simultaneously adjust the plurality of locking members from the locked position to an unlocked position, thereby enabling the plurality of biasing members to drive the plurality of gates to the open position.

18. The gate system of claim 16, wherein the first and second compressible sheet are configured to block passage of a guest through the respective gate while the respective gate is in the closed position and are configured to compress as the respective gate moves from the closed position to the open position.

19. The gate system of claim 16, wherein the plurality of locking members are configured to default the plurality of gates to the linear configuration.

20. The gate system of claim 16, wherein each of the plurality of locking members comprise an electromagnetic lock, wherein the plurality of gates revert to the open position in response to a loss of power supplied to the electromagnetic lock.

* * * * *